US006088013A

United States Patent [19]

Montour et al.

[11] Patent Number: 6,088,013

[45] Date of Patent: Jul. 11, 2000

[54] ARRAY ADDRESSING OF PNEUMATICALLY SWITCHED IMAGE DISPLAY DEVICE

[75] Inventors: Michael James Montour; Robin John Noel Coope, both of Vancouver, Canada

[73] Assignee: The University of British Columbia, Vancouver, Canada

[21] Appl. No.: 08/917,615

[22] Filed: Aug. 26, 1997

[51] Int. Cl.[7] ..... G09G 3/34

[52] U.S. Cl. ..... 345/109; 345/48

[58] Field of Search ..... 345/109, 48, 85, 345/108; 40/477, 510

[56] References Cited

U.S. PATENT DOCUMENTS

| | | | |
|---|---|---|---|
| 3,959,902 | 6/1976 | Suzuki | 40/477 |
| 4,003,149 | 1/1977 | De Vries | 40/452 |
| 5,658,719 | 8/1997 | Sawyer | 430/523 |

*Primary Examiner*—Steven J. Saras
*Assistant Examiner*—Alecia D. Nelson
*Attorney, Agent, or Firm*—Oyen Wiggs Green & Mutala

[57] ABSTRACT

Apparatus for controlling an image display device having at least one element with a reflective state in which incident light undergoes total internal reflection and a non-reflective state in which the total internal reflection is prevented. A member is positioned adjacent the element for deformation of the member between a first position in which a gap remains between the member and the element and a second position in which the member is in optical contact with the element. The apparatus incorporates a support structure having one or more display chambers. Each display chamber contains one of the elements and members aforesaid. A first aperture is provided in the support structure for air communication between the display chamber and a second chamber provided in the support structure. A preferably elastomeric valve member is provided in the second chamber, for deformation of the valve member between a closed position in which the valve member is biased against the first aperture to prevent air communication through the first aperture and an open position in which the valve member is biased away from the first aperture to permit air communication through the first aperture. A second aperture is provided in the support structure for air communication against a base of the valve member; and, a third aperture is provided in the support structure for air communication through the second chamber and through the first aperture when the valve member is in the open position.

16 Claims, 5 Drawing Sheets

ARRAY ADDRESSING OF PNEUMATICALLY SWITCHED IMAGE DISPLAY DEVICE

TECHNICAL FIELD

This application pertains to a method and apparatus for controllably switching the total internal reflection phenomenon on or off in an array of corner reflector pixels, to display text or images.

BACKGROUND

Corner reflectors (also known as "corner cubes") are well known reflective devices. A light ray incident upon a corner reflector undergoes total internal reflection in each of three separate reflections at the three perpendicularly opposed facets which form the corner, with the net result that the light is retro-reflected from the corner reflector in a direction opposite to the direction of the incident ray.

Miniaturized transparent groupings of corner reflectors, each of which reflectors exhibit the abovedescribed phenomenon of total internal reflection, are commonly found in reflective sheeting materials such as 3M Diamond Grade™ reflective sheeting. A group of one or more corner reflectors can be made to function as an image "pixel" by switching the total internal reflection phenomenon on or off. An array of such pixels can be assembled to construct a display device capable of displaying text or images.

FIGS. 1A and 1B depict, in cross-section, a grouping 10 of retro-reflective elements, namely corner reflectors. Only two facets of each corner reflector 12A, 12B, 12C, etc. are visible in such a sectional view, but persons skilled in the art will understand that each corner reflector has three perpendicularly opposed facets. Corner reflector grouping 10 may be a sheet of corner cube film such as that found in 3M Diamond Grade™ reflective sheet film material.

It is well known that light travels at different speeds in different materials. The change of speed results in refraction. The relative refractive index between two materials is given by the speed of an incident light ray divided by the speed of the refracted ray. If the relative refractive index is less than one, then light will be refracted towards the surface, eg light emerging from a glass block into air. At a particular angle of incidence "i", the refraction angle "r" becomes 90° as the light runs along the block's surface. The critical angle "i" can be calculated, as sin i=relative refractive index. If "i" is made even larger, then all of the light is reflected back inside the glass block and none escapes from the block. This is called total internal reflection. Because refraction only occurs when light changes speed, it is perhaps not surprising that the incident radiation emerges slightly before being totally internally reflected, and hence a slight penetration (roughly one micron) of the interface, called "evanescent wave penetration" occurs. By interfering with (i.e. scattering and/or absorbing) the evanescent wave one may prevent total internal reflection.

In FIG. 1A, grouping 10 is "on", such that incident light ray 14 is retro-reflected by corner reflector 12D due to the phenomenon of total internal reflection. Corner reflector grouping 10 thus constitutes a single "pixel" which can be made to appear white when "on", due to the high reflectivity exhibited by the corner reflectors. In FIG. 1B, corner reflector grouping 10 is "off", such that incident light ray 16 is not reflected by corner reflector 12D due to prevention of the phenomenon of total internal reflection. When in the "off" state, grouping 10 can easily be made to appear black, due to the low reflectivity exhibited by the corner reflectors in the off state. An array of such "pixels", each comprising a separate grouping of corner reflectors can accordingly be assembled to form a black on white display capable of displaying text or images.

One way of switching the total internal reflection capability of corner reflector grouping 10 on or off is to mount a sheet of elastomeric film material 18 adjacent the rear surface of corner reflector grouping 10, as seen in FIGS. 1A and 1B. In FIG. 1A, a small gap 20 is left between the adjacent faces of the sheet film materials comprising corner reflector grouping 10 and elastomeric sheet 18. With gap 20 present, elastomeric sheet 18 has no effect on corner reflector grouping 10. This is because gap 20 is much larger than one micron and therefore does not interfere with the evanescent wave and hence does not prevent the total internal reflection capability of corner reflector grouping 10. Thus, the "pixel" formed by corner reflector grouping 10 is "on" if gap 20 is present.

However, in FIG. 1B, control means 19 has been activated to move elastomeric sheet 18 in the direction of arrow 21 such that the adjacent faces of corner reflector grouping 10 and elastomeric sheet 18 are in "optical contact" with one another. Optical contact between elastomeric sheet 18 and corner reflector grouping 10 brings elastomeric sheet 18 substantially closer than one micron to corner reflector grouping 10, thereby scattering and/or absorbing the evanescent wave adjacent corner reflector grouping 10, thus preventing the capability of corner reflector grouping 10 to totally internally reflect incident light ray 16. The "pixel" formed by corner reflector grouping 10 is accordingly "off" if the adjacent faces of corner reflector grouping 10 and elastomeric sheet 18 are in optical contact with one another, with no gap between them.

The present invention pertains to a suitable form of control means 19 capable of displacing elastomeric sheet 18 through the small displacements required to either form gap 20 or to achieve optical contact between elastomeric sheet 18 and corner reflector grouping 10.

SUMMARY OF THE INVENTION

The invention facilitates control of an image display device having at least one element with a reflective state in which incident light undergoes total internal reflection, and a non-reflective state in which total internal reflection is prevented. The image display device has a member which can be deformed between a first position in which a gap remains between the member and the element, and a second position in which the member is in optical contact with the element. The invention provides a support structure in which a display chamber is formed. The display chamber contains the element and the member. A first aperture is provided in the support structure for air communication between the display chamber and a second chamber provided in the support structure. A valve member provided in the second chamber is deformable between a closed position in which the valve member is biased against the first aperture to prevent air communication through the first aperture, and an open position in which the valve member is biased away from the first aperture to permit air communication through the first aperture. A second aperture is provided in the support structure for air communication against a base of the valve member. A third aperture is provided in the support structure for air communication through the second chamber and through the first aperture when the valve member is in the open position.

The valve member is preferably elastomeric and may advantageously be an elastomeric sheet.

The invention also provides a method of controlling an image display device of the type described above. The aforementioned element and member are isolated within a display chamber. Pressurized air communication between the display chamber and a second chamber is then controlled by opening an air communication path between the display chamber and the second chamber. While the air communication path is open, a pressurized air source is connected to the second chamber; or, alternatively, the pressurized air source is disconnected from the second chamber. The air communication path is then closed. The closing operation may be performed by connecting a second pressurized air source to deform a valve member into air obstructing engagement with the air communication path; and, the opening operation may be performed by disconnecting the second pressurized air source to remove the valve member from obstructing the air communication path.

The invention is readily adaptable to use with multiple pixel image display devices.

DESCRIPTION

Figure 1A:
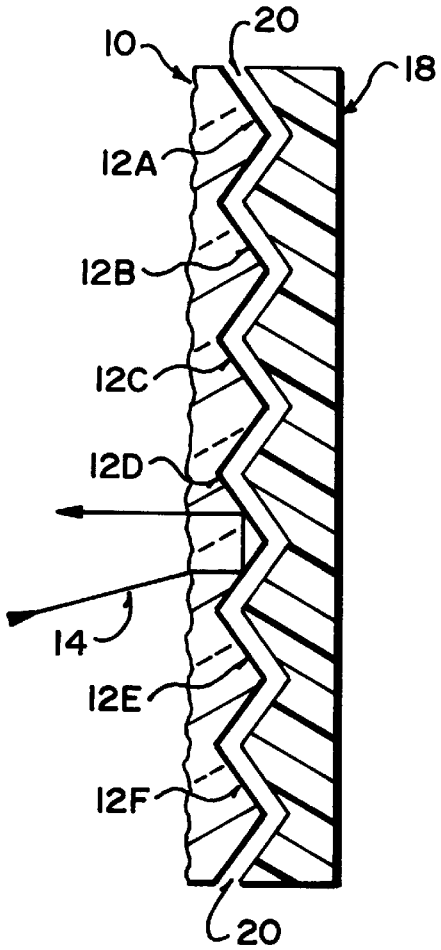
FIG. 1A is a cross-sectional illustration of a corner reflector grouping exhibiting high reflectivity due to the phenomenon of total internal reflection.
Figure 1B:
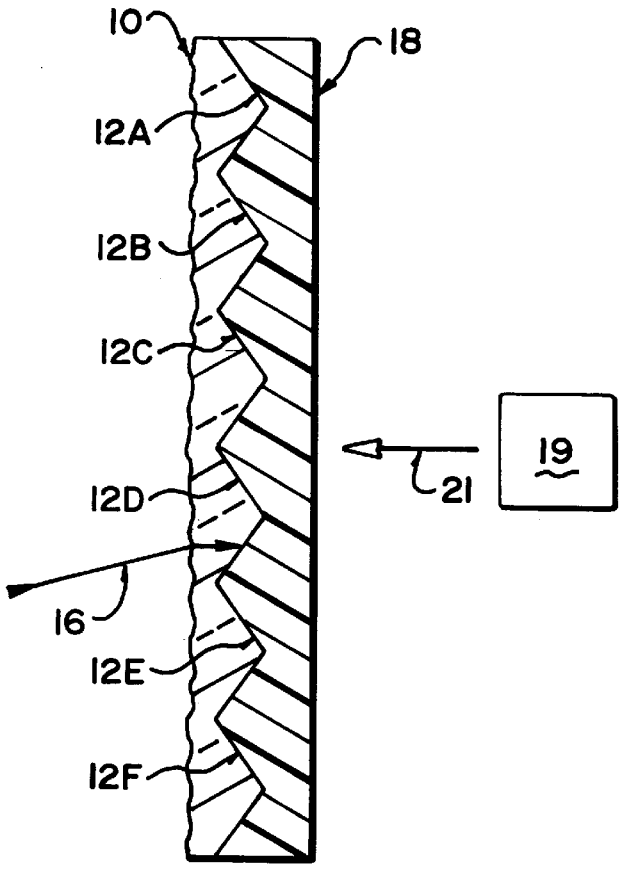
FIG. 1B is a cross-sectional illustration of a corner reflector grouping exhibiting low reflectivity due to prevention of total internal reflection.
Figure 2A:
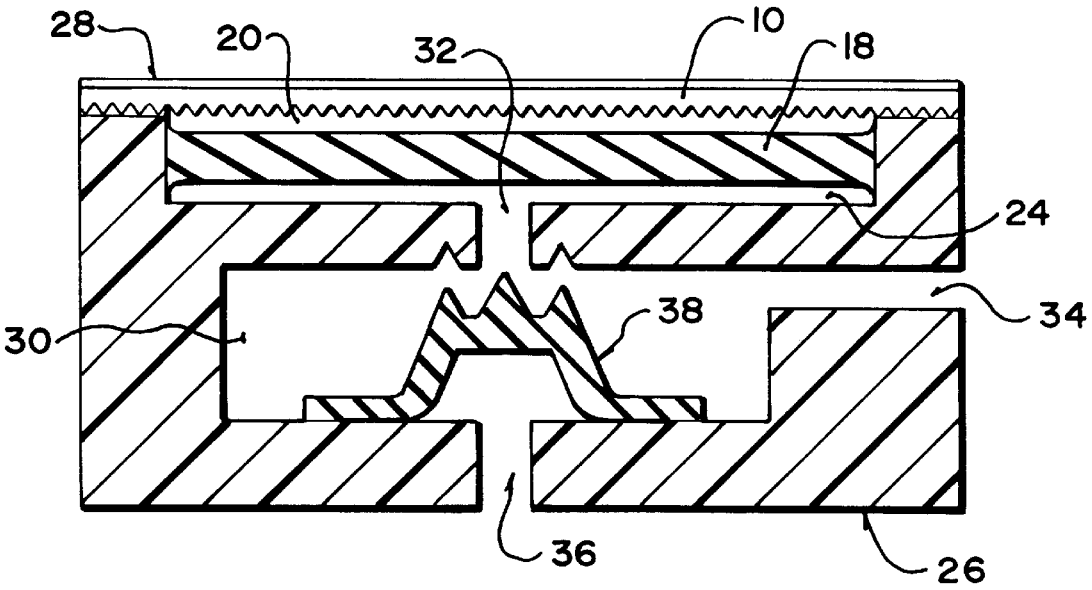
FIG. 2A is a cross-sectional illustration of a ridged membrane valve in the open position.
Figure 2B:
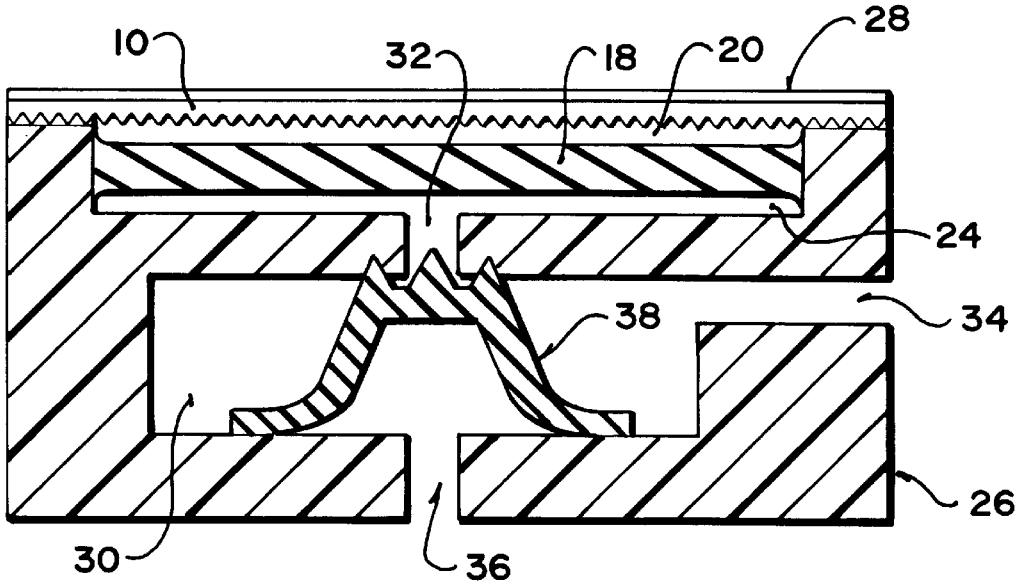
FIG. 2B shows the FIG. 2A valve in the closed position.

FIGS. 2A and 2B show, in cross-section, a single "pixel" as described above with respect to FIGS. 1A and 1B. Corner reflector grouping 10 and elastomeric sheet 18 are mounted in a frontal display chamber 24 provided in support structure 26, behind protective transparent cover 28. A rearward chamber 30 is provided in support structure 26, with aperture 32 communicating between chambers 24, 30. A "data" aperture 34 and a "control" aperture 36 communicate between rearward chamber 30 and separate "data" and "control" pressurized air lines (not shown). An elastomeric valve 38 is mounted in rearward chamber 30 over control aperture 36, for controlled displacement of valve 38 between the positions shown in FIGS. 2A and 2B.

More particularly, if the control line introduces pressurized air through control aperture 36 then elastomeric valve 38 is deformed against the base of aperture 32, sealing aperture 32 as shown in FIG. 2B and thus preventing air communication via apertures 32, 34 between display chamber 24 and the pressurized data air line. If the pressure at control aperture 36 is released then valve 38 resumes its non-deformed state and pulls away from aperture 32 as shown in FIG. 2A, permitting air communication via apertures 32, 34 between display chamber 24 and the pressurized data air line. Valve 38 can thus be used to latch corner reflector grouping 10 and elastomeric sheet 18 into either the on or off state.

For example, suppose that it is desired to latch the pixel into the "on" state, in which gap 20 is present between corner reflector grouping 10 and elastomeric sheet 18. This can be achieved by initially releasing the pressure at control aperture 36 to allow valve 38 to pull away from aperture 32, permitting air communication between display chamber 24 and the pressurized data air line. Pressure is then released at data aperture 34 to form gap 20 (and thus turn the pixel "on") by allowing elastomeric sheet 18 to assume its non-deformed state and pull away from corner reflector grouping 10. Finally, pressure is applied at control aperture 36 to deform valve 38 against aperture 32, thus latching the pixel in the on state by preventing further communication between display chamber 24 and data aperture 34. The same operation is used to latch the pixel into the "off" state, except that in the intermediate step, pressure is applied at data aperture 34 to deform elastomeric sheet 18 into optical contact with corner reflector grouping 10 20 (and thus turn the pixel "off"). To provide reliable switching, the pressure applied to control aperture 36 is preferably higher than that applied to data aperture 34.

Figure 3A:
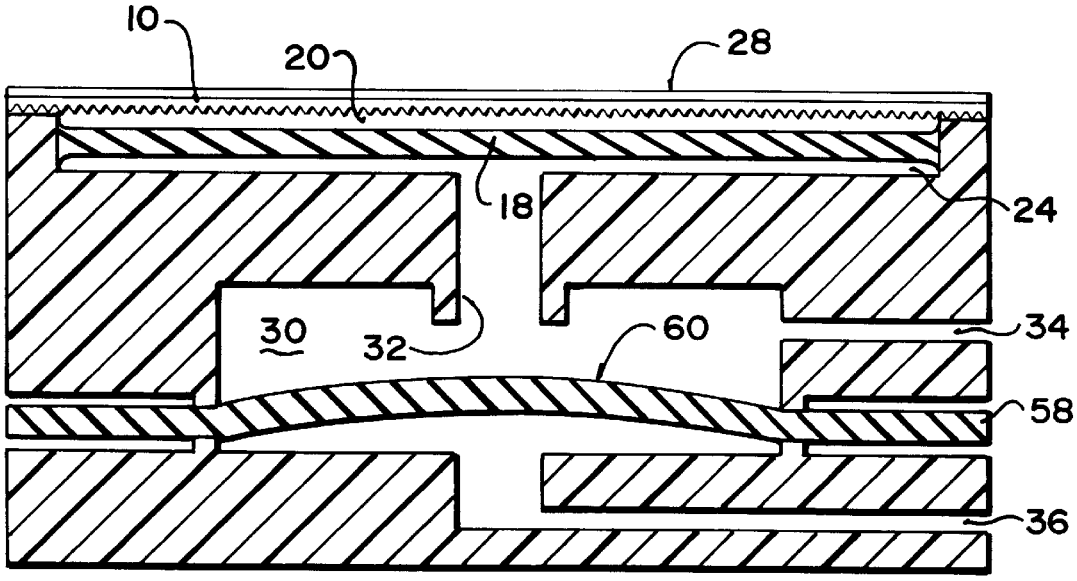
FIG. 3A is a cross-sectional illustration of an elastomeric sheet membrane valve in the open position.
Figure 3B:
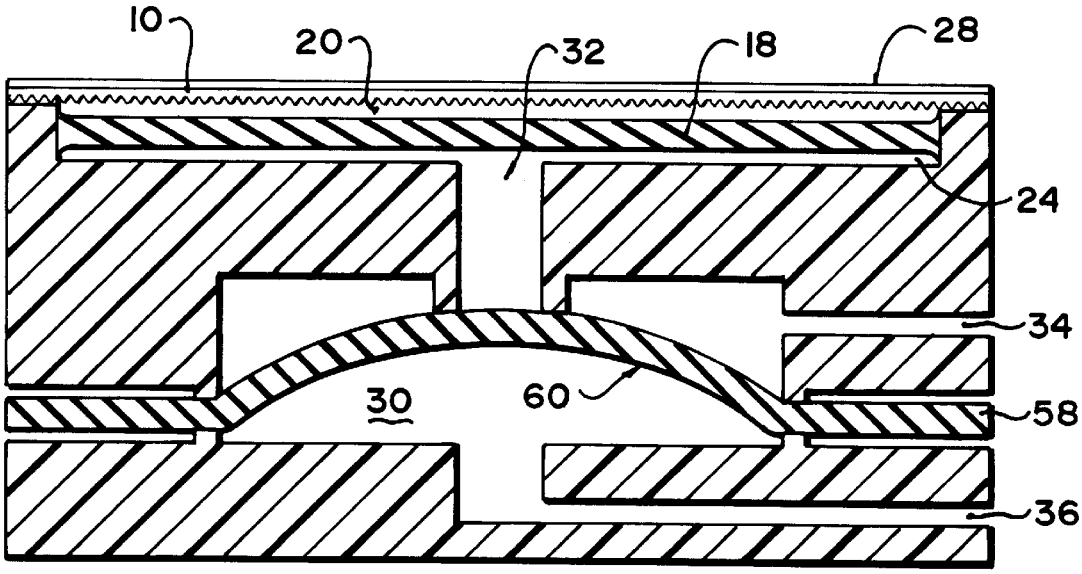
FIG. 3B shows the FIG. 3A valve in the closed position.
Figure 4:
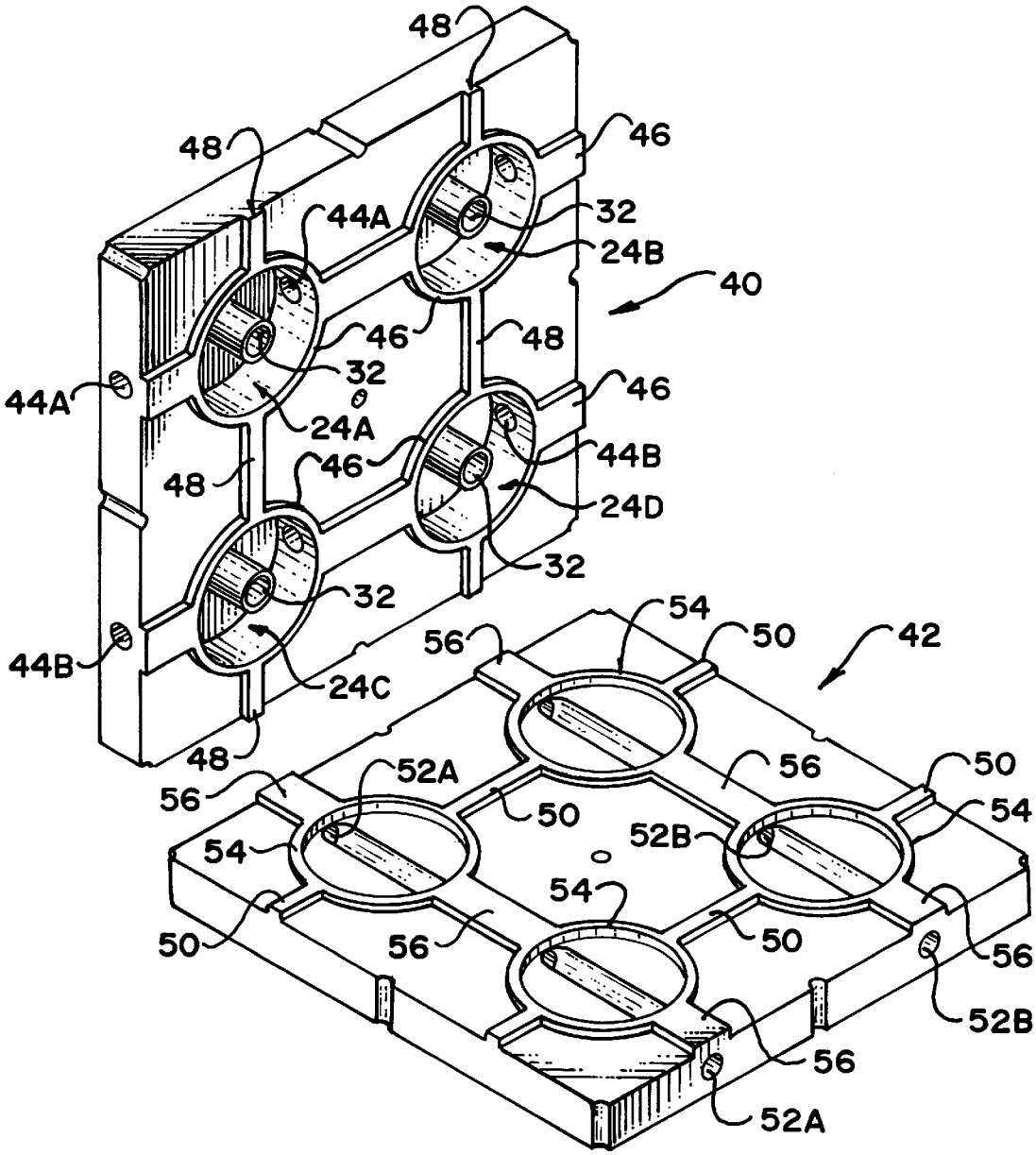
FIG. 4 is an oblique pictorial illustration of a pair of plates respectively formed with air channel rows and columns.

FIGS. 3A, 3B and 4 show how the invention is adapted to row and column addressing of an array of pixels. FIG. 4 depicts a pair of plates 40, 42. As illustrated, four display chambers 24A, 24B, 24C and 24D are formed in plate 40, but in practice plate 40 may be of any desired size and may have any desired number of display chambers. The display chambers are preferably formed in a rectangular array, as shown, each chamber having an aperture 32. Parallel, linearly extending "data" passages 44A, 44B are formed in plate 40, such that each passage intersects one linearly extending column of display chambers. Thus, data passage 44A intersects display chambers 24A, 24B; and, data passage 44B intersects display chambers 24C, 24D. Outwardly extending ridges 46 are formed on plate 40 around the edge of each display chamber. Parallel rows of outwardly extending ribs 48 are also formed on plate 40. Ribs 48 extend perpendicularly to the columns formed by the display chambers, with each rib intersecting one such column.

Plate 42 is formed with parallel rows of outwardly extending ribs 50. When the inward faces of plates 40, 42 are aligned over one another, each of ribs 50 lies adjacent a corresponding one of the longitudinally extending portions of ribs 46 on plate 40. Parallel, linearly extending "control" passages 52A, 52B are formed in plate 42, with each control passage intersecting one linearly extending row of outwardly extending circumferential ridges 54 formed on plate 42. Ridges 54 have the same size, shape and relative position as the portions of ridges 46 which encircle the display chambers in plate 40. Accordingly, corresponding pairs of ridges 46, 54 lie adjacent one another when the inward faces of plates 40, 42 are oriented and aligned over one another. Additional outwardly extending ridges 56 are formed on plate 42 in juxtaposition to ridges 48 on plate 40. An elastomeric (i.e. neoprene rubber) sheet 58 (FIGS. 3A, 3B) is placed between plates 40, 42. The plates are oriented and aligned as aforesaid, then fastened together.

FIGS. 3A, 3B schematically depict a single pixel component of a display device fabricated in the manner described above with reference to FIG. 4. As can be seen, FIGS. 3A, 3B are very similar to FIGS. 2A, 2B except that elastomeric sheet 58 is substituted for valve 38. More particularly, a single elastomeric sheet 58 can be substituted for a large number of separate valves 38, thereby significantly reducing manufacturing costs and simplifying fabrication of display devices. When plates 40, 42 are fastened together as aforesaid, elastomeric sheet 58 is compressed between ridges 46, 54 at each individual display chamber. Thus, a portion of elastomeric sheet 58 is held firmly in place with respect to each display chamber, allowing such portions to serve as separate valve membranes. Elastomeric sheet 58 simultaneously acts as a seal wherever it contacts ridges 46, 54, 56 or ribs 48, 50.

Accordingly, if pressurized air is introduced through the control aperture 36 shown in FIG. 3B, then the adjacent portion 60 of elastomeric sheet 58 is deformed against the base of aperture 32, preventing air communication between display chamber 24 and data aperture 34. If the pressure at control aperture 36 is released then elastomeric sheet portion 60 resumes its non-deformed state and pulls away from aperture 32 as shown in FIG. 3A, permitting air communication between display chamber 24 and the data aperture 34. Elastomeric sheet portion 60 can thus be used to latch corner reflector grouping 10 and elastomeric sheet 18 into either the on or off state, as described above with reference to FIGS. 2A, 2B.

Figure 5:
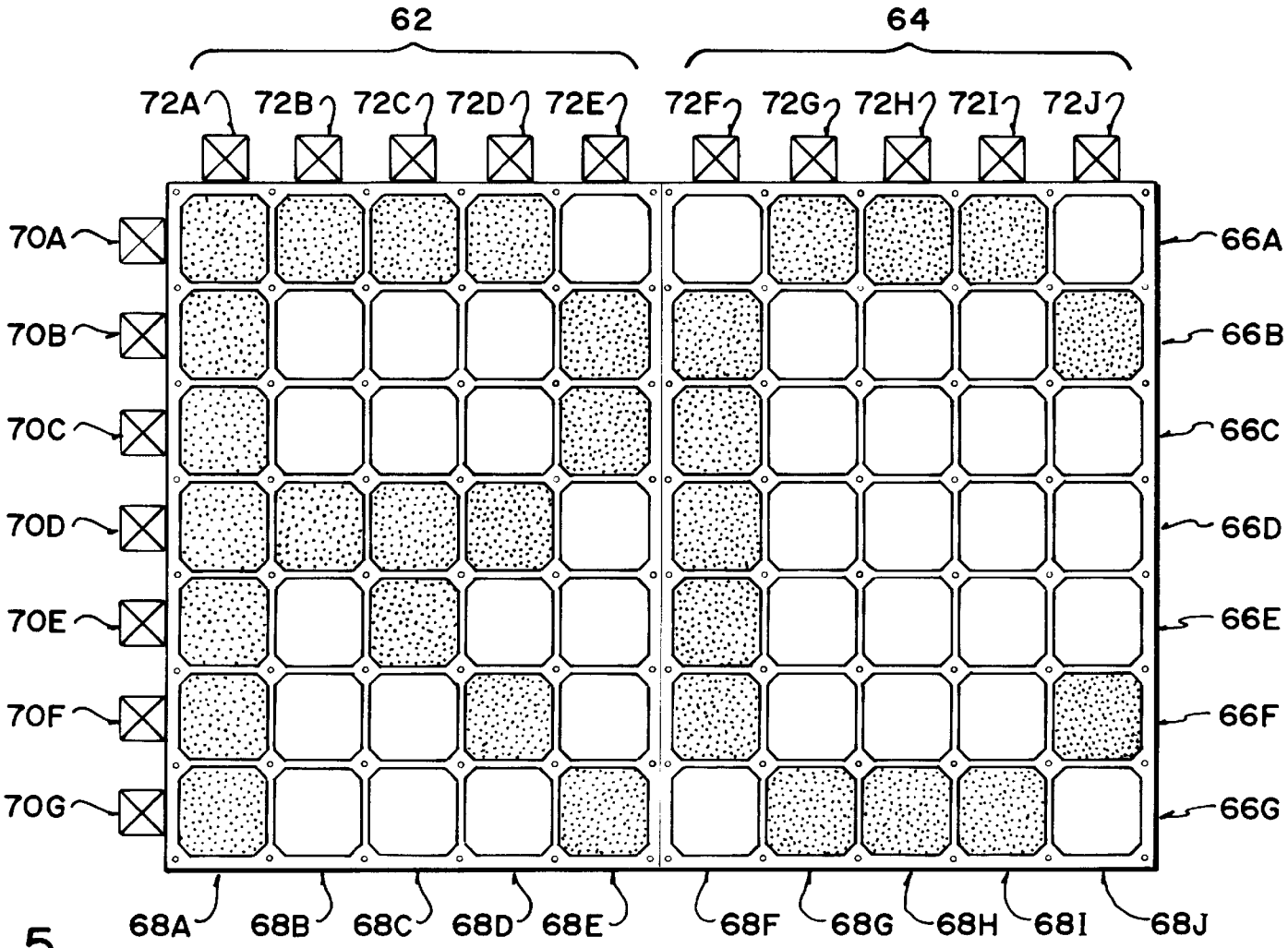
FIG. 5 is a front elevation view of a row and column addressable display having two 5×7 pixel character cells.

FIG. 5 shows a display having two display cells 62, 64. Cells 62, 64 are each composed of a 5×7 rectangular array of pixels, with each pixel being similar to the pixel described above and shown in FIGS. 3A, 3B. Accordingly, the full display is made up of seven horizontally extending rows 66A–66G of pixels; and, ten vertically extending columns 68A–68J of pixels. Seven row "control" valves 70A–70G and ten column "data" valves 72A–72J are provided. The control apertures of all ten pixels in row 66A are connected to control valve 70A, the control apertures of all ten pixels in row 66B are connected to control valve 70B, etc. The data apertures of all seven pixels in column 68A are connected to data valve 72A, the data apertures of all seven pixels in column 68B are connected to data valve 72B, etc. It can thus be seen that it is possible to control a rectangular pixel matrix of N rows and M columns using not more than (N+M) valves, with each individual pixel capable of being selectively latched on or off as described above.

In operation, when control valves 70A–70G are opened to apply pressure to all of the rows (and therefore, to every pixel's control port), the elastomeric sheet portion associated with each pixel is deformed against the base of that pixel's aperture 32, preventing air communication between the pixel's display chamber 24 and data aperture 34. Therefore, the display chambers are isolated and retain their respective states (i.e. either on or off) regardless of the pressure in the data columns. If the pressure is now released from one row, the elastomeric sheet portions associated with the pixels in that row resume their non-deformed state and pull away from each pixel's aperture 32, permitting air communication between display chamber 24 and data aperture 34. Each pixel in that row can then be set into the desired state by applying the appropriate pressures to the data columns. When pressure is re-applied to that row, the new state of each pixel is latched as aforesaid. Each row can be sequentially controlled in the same fashion, thereby facilitating control of the state of the entire display.

In principle, it is only necessary to perform the aforementioned control operations on those rows for which the on or off values to be displayed change in comparison to the previously latched values. However, because of air leakage, it will probably be necessary to refresh the display periodically, even when the latched values do not change.

As will be apparent to those skilled in the art in the light of the foregoing disclosure, many alterations and modifications are possible in the practice of this invention without departing from the spirit or scope thereof. For example, instead of using separate electro-mechanical valves 70 for each row, a further cost reduction could be achieved by providing a single valve capable of producing the required sequence of pressures. This could, for example, be a rotating cylinder which selectively exposes vent holes to release the pressure one row at a time.

As another example, the invention is not restricted to formation of rectangular display arrays, but can also be used to form multiple-segment display elements such as the 7-segment numerals often seen in digital clock or scoreboard displays. In such case each numeral is analogous to a 'row' and each segment analogous to a 'column'.

Finally, it should be noted that the designations 'row' and 'column' are arbitrary and interchangeable with one another. Accordingly, the scope of the invention is to be construed in accordance with the substance defined by the following claims.

What is claimed is:

1. Apparatus for controlling an image display device having at least one element with a reflective state in which incident light undergoes total internal reflection and a non-reflective state in which said total internal reflection is prevented, and having a member positioned adjacent said element for deformation of said member between a first position in which a gap remains between said member and said element and a second position in which said member is in optical contact with said element, said apparatus comprising:

a. a support structure;

b. a display chamber in said support structure, said display chamber for containing said element and said member;

c. a first aperture in said support structure for air communication between said display chamber and a second chamber in said support structure;

d. a valve member in said second chamber, said valve member deformable between a closed position in which said valve member is biased against said first aperture to prevent air communication through said first aperture and an open position in which said valve member is biased away from said first aperture to permit air communication through said first aperture;

e. a second aperture in said support structure for air communication against a base of said valve member; and, f. a third aperture in said support structure for air communication through said second chamber and through said first aperture when said valve member is in said open position.

2. Apparatus as defined in claim 1, wherein said valve member is elastomeric.

3. Apparatus as defined in claim 1, wherein said valve member is an elastomeric sheet.

4. Apparatus for controlling a multiple pixel image display device, each of said pixels having at least one element with a reflective state in which incident light undergoes total internal reflection and with a non-reflective state in which said total internal reflection is prevented, and having a member positioned adjacent said element for deformation of said member between a first position in which a gap remains between said member and said element and a second position in which said member is in optical contact with said element, said apparatus comprising:

a. a support structure;

b. a plurality of display chambers in said support structure, each one of said display chambers corresponding to one of said pixels and containing one of said elements and one of said members;

c. a plurality of first apertures in said support structure, each one of said first apertures for air communication between one of said display chambers and a corresponding one of a plurality of second chambers in said support structure;

d. a plurality of valve members, each one of said valve members in a corresponding one of said second chambers, said valve members respectively deformable between a closed position in which said valve member is biased against a corresponding one of said first apertures to prevent air communication through said first aperture and an open position in which said valve member is biased away from said corresponding first aperture to permit air communication through said corresponding first aperture;

e. a plurality of second apertures in said support structure, each one of said second apertures for air communication against a base of a corresponding one of said valve members; and, f. a plurality of third apertures in said support structure, each one of said third apertures for air communication through a corresponding one of said second chambers and through a corresponding one of said first apertures when said corresponding valve member is in said open position.

5. Apparatus as defined in claim 4, wherein said valve members are elastomeric.

6. Apparatus as defined in claim 4, wherein said valve members further comprise separate portions of an elastomeric sheet.

7. Apparatus as defined in claim 4, wherein said pixels are arranged in an array of rows and columns, said apparatus further comprising:

a. for each one of said rows, an air conduit interconnecting all of said second apertures of said pixels in said one row; and, b. for each one of said columns, an air conduit interconnecting all of said third apertures of said pixels in said one column.

8. Apparatus as defined in claim 4, further comprising:

a. for each one of said rows, a valve for controlling delivery or release of pressurized air into said air conduit interconnecting all of said second apertures of said pixels in said one row; and, b. for each one of said columns, a valve for controlling delivery or release of pressurized air into said air conduit interconnecting all of said third apertures of said pixels in said one column.

9. Apparatus for controlling a multiple pixel image display device, each of said pixels having at least one element with a reflective state in which incident light undergoes total internal reflection and with a non-reflective state in which said total internal reflection is prevented, and having a member positioned adjacent said element for deformation of said member between a first position in which a gap remains between said member and said element and a second position in which said member is in optical contact with said element, said apparatus comprising:

a. first and second plates;

b. a plurality of display chambers formed in said first plate, each one of said display chambers corresponding to one of said pixels and containing one of said elements and one of said members;

c. a first aperture in each one said display chambers, each one of said first apertures for air communication between one of said display chambers and a corresponding one of a plurality of second chambers in said first plate;

d. an elastomeric sheet disposed between said plates to provide a separate portion of said sheet adjacent a corresponding one of said second chambers, each of said portions deformable between a closed position in which said portion is biased against a corresponding one of said first apertures to prevent air communication through said first aperture and an open position in which said portion is biased away from said corresponding first aperture to permit air communication through said corresponding first aperture;

e. a plurality of second apertures in one of said plates, each one of said second apertures for air communication against a base of a corresponding one of said elastomeric sheet portions; and, f. a plurality of third apertures in one of said plates, each one of said third apertures for air communication through a corresponding one of said second chambers and through a corresponding one of said first apertures when said corresponding elastomeric sheet portion is in said open position.

10. Apparatus as defined in claim 9, wherein said pixels are arranged in an array of rows and columns, said apparatus further comprising:

a. for each one of said rows, an air conduit interconnecting all of said second apertures of said pixels in said one row; and, b. for each one of said columns, an air conduit interconnecting all of said third apertures of said pixels in said one column.

11. Apparatus as defined in claim 9, further comprising:

a. for each one of said rows, a valve for controlling delivery or release of pressurized air into said air conduit interconnecting all of said second apertures of said pixels in said one row; and, b. for each one of said columns, a valve for controlling delivery or release of pressurized air into said air conduit interconnecting all of said third apertures of said pixels in said one column.

12. A method of controlling an image display device having at least one element with a reflective state in which incident light undergoes total internal reflection and a non-reflective state in which said total internal reflection is prevented, and having a member positioned adjacent said element for deformation of said member between a first position in which a gap remains between said member and said element and a second position in which said member is in optical contact with said element, said method comprising the steps of:

a. isolating said element and said member within a display chamber;

b. controlling pressurized air communication between said display chamber and a second chamber by:

i. opening an air communication path between said display chamber and said second chamber;

ii. while said air communication path is open, either:

(1) connecting a pressurized air source to said second chamber; or, (2) disconnecting said pressurized air source from said second chamber; and, iii. closing said air communication path.

13. A method as defined in claim 12, wherein said closing step further comprises connecting a second pressurized air source to deform a valve member into air obstructing engagement with said air communication path, and wherein said opening step further comprises disconnecting said second pressurized air source to remove said valve member from obstructing said air communication path.

14. A method of controlling a multiple pixel image display device, each of said pixels having at least one element with a reflective state in which incident light undergoes total internal reflection and with a non-reflective state in which said total internal reflection is prevented, and having a member positioned adjacent said element for deformation of said member between a first position in which a gap remains between said member and said element and a second position in which said member is in optical contact with said element, said method comprising the steps of:

a. isolating said elements and members within said display chambers, with one of said elements and one of said members in each one of said display chambers;

b. controlling pressurized air communication between each one of said display chambers and a corresponding second chamber by:

i. opening an air communication path between said one display chamber and said corresponding second chamber;

ii. while said air communication path is open, either:

(1) connecting a pressurized air source to said corresponding second chamber; or, (2) disconnecting said pressurized air source from said corresponding second chamber; and, iii. closing said air communication path.

15. A method as defined in claim 14, wherein said closing step further comprises connecting a second pressurized air source to deform a valve member into air obstructing engagement with said air communication path, and wherein said opening step further comprises disconnecting said second pressurized air source to remove said valve member from obstructing said air communication path.

16. A method as defined in claim 15, wherein said pixels are arranged in an array of rows and columns, said method further comprising performing said controlling step sequentially with respect to each of said rows.

* * * * *